United States Patent [19]

Cyphert et al.

[11] 4,136,420

[45] Jan. 30, 1979

[54] CARPET SOIL EXTRACTING WAND HAVING A POWERED BRUSH

[75] Inventors: Gilbert C. Cyphert, Glendale; Patrick E. Lynch, Jr., Phoenix, both of Ariz.

[73] Assignee: Chemko Industries, Inc., Phoenix, Ariz.

[21] Appl. No.: 787,932

[22] Filed: Apr. 15, 1977

[51] Int. Cl.[2] ..... A47L 7/00; A47L 11/34

[52] U.S. Cl. ..... 15/321; 15/50 A; 15/381

[58] Field of Search ..... 15/320, 321, 322, 381, 15/49 RB, 50 A; 8/158

[56] References Cited

U.S. PATENT DOCUMENTS 3,959,844 6/1976 Cyphert ..... 15/320

4,014,067 3/1977 Bates ..... 15/320

*Primary Examiner*—Edward L. Roberts

*Attorney, Agent, or Firm*—Cahill, Sutton & Thomas

[57] ABSTRACT

In a carpet soil extracting wand having nozzles for dispensing a cleaning solution and a vacuum head for extracting the mixture of dirt and cleaning solution, a powered brush reciprocally travels through a predetermined arc to scrub the carpet. Bias means are included to allow variation in the pressure exerted by the reciprocating brush upon the pile of the carpet. For manually operated carpet soil extractors, the handle is pivotally positionable for ease of use while the interconnecting conduits to sources of vacuum and cleaning solution are maintained rigid.

27 Claims, 7 Drawing Figures

CARPET SOIL EXTRACTING WAND HAVING A POWERED BRUSH

The present invention is an improvement of a device described in an application for United States Letters Patent entitled "Carpet Soil Extractor", filed Apr. 15, 1976 and assigned Ser. No. 677,264, now U.S. Pat. No. 4,019,218 and describing an earlier invention assigned to the present assignee.

The present invention relates to carpet cleaning machinery and, more particularly, to powered brushes for use in carpet soil extractors.

It is well known that carpets which are cleaned regularly not only have a better appearance but also wear significantly longer than carpets which are permitted to carry traffic while soiled. Much of the particulate matter which forms a part of the dirt within a carpet is abrasive in nature. Continual traffic upon a dirty carpet tends to cause the abrasive particulate matter to abrade the pile and backing of the carpet. Furthermore, all of the dirt is continually forced deeper and deeper into the carpet.

Although it is possible to pick up a carpet and transport it to a facility for cleaning, many carpets cannot, as a practical matter, be removed from their location. Wall to wall carpet installations are somewhat permanent in nature also and it is not contemplated that such a carpet is to be removed for cleaning or other purposes. It can be readily understood that in many installations, it is particularly advantageous if the carpet could be cleaned in situ rather than removed to a distant point for cleaning.

Many cleaning methods apply water to the carpet being cleaned. Unless great care is taken, the water can create substantial problems. Among these problems are: the backing material of many carpets shrinks or decomposes if allowed to remain wet; underlying surfaces, such as oak flooring, are ruined by water; if the dye is not waterfast, it will run or fade; all normal traffic must be rerouted for a substantial period of time since a wet carpet should not be walked upon; and, all furniture must be removed from the entire carpet surface while the carpet is drying.

Normally, water or a solution of water and cleaning agent is ejected through nozzles to strike the carpet with a substantial force. The bombardment of the carpet by the water tends to dislodge dirt entrained within the nap and, when a chemical solution is employed, it tends to aid severing particles of dirt adhering to strands of the carpet material. A chemical solution is sometimes employed which will dissolve or liquify certain particulate dirt and thereby aid in extraction of the dirt. Aside from the dirt dislodgement by the impact force of the discharged water and the chemical action of a cleaning solution, agitation means, such as a brush, is often employed to encourage mixing of the dirt with the ejected water or cleaning solution.

Accordingly, it is well known to distribute a solution of water and cleaning agent on the surface of a carpet, agitate the mixture into the pile of the carpet to loosen the retained dirt by the scrubbing action of a brush and then vacuum the mixture of dirt and solution from the carpet surface. Thereby, the dirt removal is effective and the carpet is not left in a soaked state to dry by evaporation.

Commonly, when a brush is employed to agitate and scrub the pile of a carpet, it is a rotary brush. Apparatus employing such brushes are disclosed and described in the following U.S. Pat. No. 2,726,807, which illustrates a rotary brush rotating about a vertical axis. U.S. Pat. Nos. 2,910,720, 3,392,418, 3,402,420, 3,699,607 and 3,871,051 teach the use of rotary brushes rotating about a horizontal axis. While all of these brushes do scrub the pile of a carpet, certain inherent difficulties are encountered. First, the scrubbing action occurs in only one direction whereby the pile is not agitated back and forth or side to side; necessarily, the brush bristles cannot come into contact with the complete surface of the strands forming the pile of the carpet. Second, the scrubbing pressure exerted by the brushes upon the pile is a function of the rotational speed of the brush and downward bias exerted upon the brush; because of the mechanical coupling of a rotary brush, adjustments of the bias are necessarily mechanically difficult and changes in rotational speed involve complex and expensive mechanisms because of inherent high torque requirements. Third, rotary brushes are expensive.

To avoid the problems of rotary brushes, other brush agitation devices have been developed which are represented by the following U.S. Pat. No. 3,117,337, discloses a sponge rubber scrubbing pad extending transverse to the direction of travel of the carpet cleaning mechanism. The scrubbing action is performed by movement of the carpet cleaning head across the carpet and no independent movement of the pad is employed. U.S. Pat. No. 3,273,193, teaches a brush oriented transverse to the direction of travel of the cleaning head and the brush is rectilinearly reciprocally translatable in the direction of travel of the cleaning unit by complex sliding sleeves. U.S. Pat. No. 3,602,933 teaches the use of a brush oriented transverse to the direction of travel of the cleaning head, which brush is rigidly mounted upon a wheel supported chassis; the pressure exerted by the bristles upon the pile is a function of the bristle length and the pile height.

It is therefore a primary object of the present invention to provide a carpet soil extracting wand which reciprocally scrubs the pile of the carpet.

Another object of the present invention is to provide scrub means for a carpet soil extracting wand which exerts a constant magnitude of pressure upon the carpet regardless of the variations in the height of the pile of the carpet.

Yet another object of the present invention is to provide a wand for a carpet soil extractor which automatically agitates the pile of the carpet to loosen and raise the dirt entrained therein upon a single pass across the carpet.

Still another object of the present invention is to provide a wand for a carpet soil extractor having a selectively biasable scrubbing means.

A further object of the present invention is to provide a pivotably mounted floating linkage suspension for a reciprocating pivoting brush in a wand of a carpet soil extractor.

A yet further object of the present invention is to provide a pivotally mounted floating linkage suspension for a reciprocating pivoting brush and biasing means for urging pivotal movement of the suspension in one direction about its mounting point.

A still further object of the present invention is to provide a variable bias for a scrubbing brush within the wand of a carpet soil extractor which maintains the snout of the vacuum head at no less than a predetermined minimum pressure upon the pile of the carpet.

A still further object of the present invention is to provide a carpet soil extractor with a parallelogram linkage for reciprocally pivoting a brush means through a predetermined arc.

These and other objects of the present invention will become apparent to those skilled in the art as the description thereof proceeds.

The present invention may be described with greater specificity and clarity with reference to the following drawings, in which.

Carpet soil extractors generally are one of three possible configurations. Some have a wand which supports a first tank for the cleaning solution, a second tank for the waste mixture and a means for developing a source of vacuum. In a variation of this type, the source of vacuum is removed from the wand itself and connectable thereto through a vacuum hose. A second type employs a wand having a trailing carrier for holding the cleaning solution, the waste mixture and a source for developing a vacuum. A third type has a wand with conduits to a non-trailing ensemble for holding the cleaning solution, receiving the waste mixture and developing a source of vacuum. The wand as described herein and particularly the brush means and related actuating mechanisms are useable with any or all of the above general types of carpet soil extractors.

Figure 1:
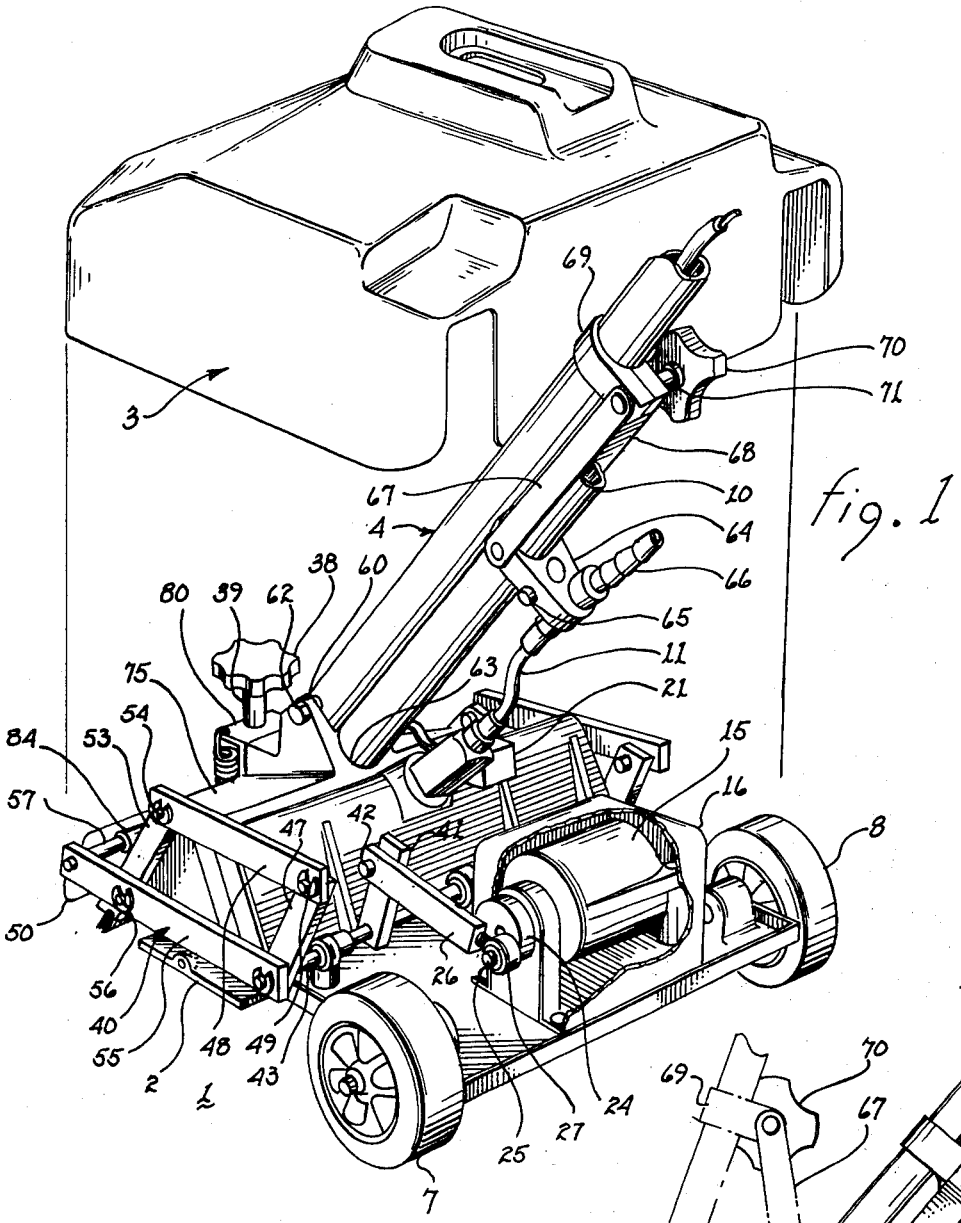
FIG. 1 is a rear quarter perspective view of a wand for a carpet soil extractor and embodying the present invention.
Figure 3:
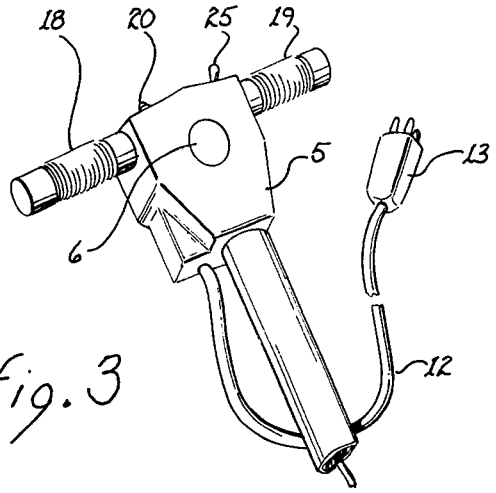
FIG. 3 is a front quarter perspective view of the wand.
Figure 4:
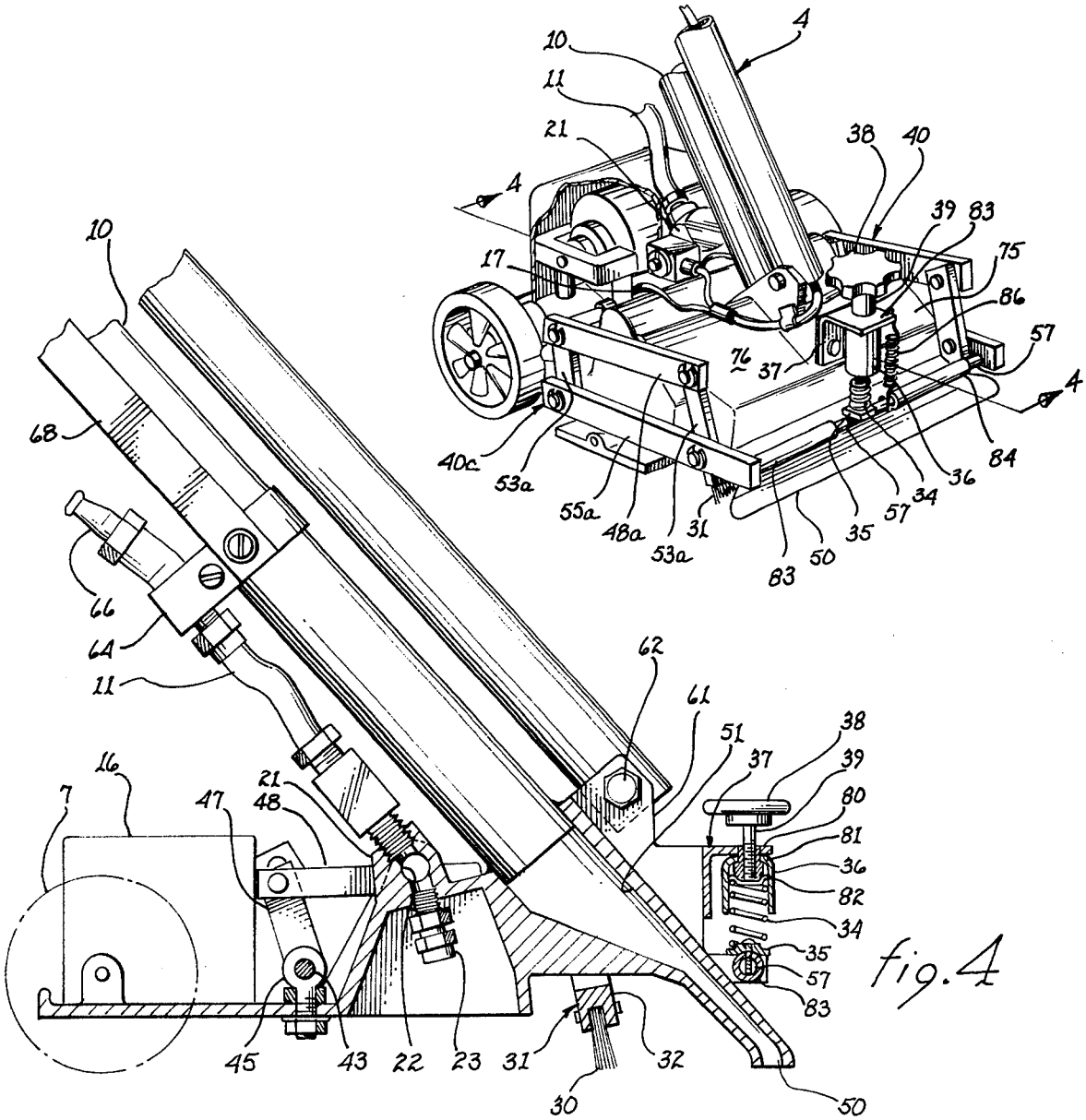
FIG. 4 is a cross-sectional view taken along lines 4—4, as shown in FIG. 3.

Referring to FIGS. 1, 3 and 4, wand 1 includes a chassis 2 for supporting the various operative elements, a removable cover 3 and an upwardly extending handle 4. One end of the chassis is raised by wheels 7 and 8 to aid in transport of the wand during both the operative and non-operative modes. Extending upwardly from chassis 2 and supported by handle 4 are conduits 10 and 11, which are, respectively, connected to a source of vacuum via a holding tank and a source of water or cleaning solution under pressure. An electrical conductor 12 is connectable through plug 13 to a source of electricity for energizing motor 15. As will be explained in detail below, upon energization of motor 15, brush 20 will reciprocally translate through a predetermined arc.

Before proceeding with a detailed description of the individual components and their interrelationships, it may be beneficial in understanding the present invention by a brief overview of the operation of wand 1. After conduits 10 and 11 and conductor 12 have been connected to their respective sources of vacuum, cleaning solution and electrical power, the wand is ready for operation. Hand grips 18 and 19, extending laterally at the upper extremity of handle 4, are grasped by an operator to pull wand 1 across the pile of a carpet. On actuation of switch 20, the cleaning solution, under pressure, will flow through conduit 11, through electrically actuated valve assembly 21 and into manifold 22 for ejection through the nozzles (of which nozzle 23 is illustrated). The force of the ejected cleaning solution will tend to cause the adjacent pile of the carpet to become permeated with the cleaning solution; some scrubbing of the pile will also occur due to the impact force of the ejected solution. By simultaneously pulling wand 1 toward the operator (wheels 7 and 8 leading), the downwardly oriented bristles 30 of brush 31 come into contact with the cleaning solution permeated pile of the carpet. On actuation of switch 25, electrical power is supplied to motor 15, which motor through a linkage mechanism, reciprocally pivots brush 31 through a predetermined arc. The reciprocal motion imparted to bristles 30 agitate and scrub the adjacent pile in cyclically opposing directions such that each strand forming the pile is scrubbed at least on opposed surfaces and more likely upon the complete surface due to the resulting agitation and reorientation of the pile. Upon continuing translation of wand 1 across the carpet, the agitated and scrubbed pile comes under the influence of snout 50 of vacuum head 51, which snout is in fluid communication with the source of vacuum via the waste water tank through conduit 10 and interconnecting hose (hose 9 in FIG. 2). Thereby, the force of the cleaning solution ejected from the nozzles wets and initially washes the pile of the carpet followed closely by the agitating and scrubbing action of brush 31. The vacuum at the snout of the vacuum head draws the dirt entrained free-standing cleaning solution from the pile and further draws practically all of the dirt entrained moisture permeated within the pile itself. Accordingly, the wand removes embedded dirt to clean the carpet with a single pass and leaves the carpet dry enough to permit normal evaporation to render the carpet useable within two to four hours.

The various segregable but co-acting mechanisms of wand 1 will now be discussed. Referring primarily to FIGS. 1, 2, 4 and 5, handle 4 and its operation will be reviewed. The handle is pivotally attached to chassis 2 at upwardly extending flanges 60 and 61 by nut and bolt means 62. Conduit 10 extends from and is rigidly secured within an aperture 63 of chassis 2; the conduit serves the secondary function of anchoring and retaining the handle at a selected angular position. A collar 64 is fixedly secured about conduit 10 by clamp means 65. The collar provides support for the disconnectable terminal end 66 of conduit 11 and supports upwardly extending pivotally mounted braces 67 and 68. A further clamp 69 encircles handle 4 and pivotally supports the upper ends of braces 67 and 68. A manually operated knob 70 having a threaded shaft 71 engages the free arms of clamp 69 such that upon turning of knob 70 in one direction the clamp frictionally engages handle 4 and loosens its grip when the knob is turned in the opposite direction.

Figure 2:
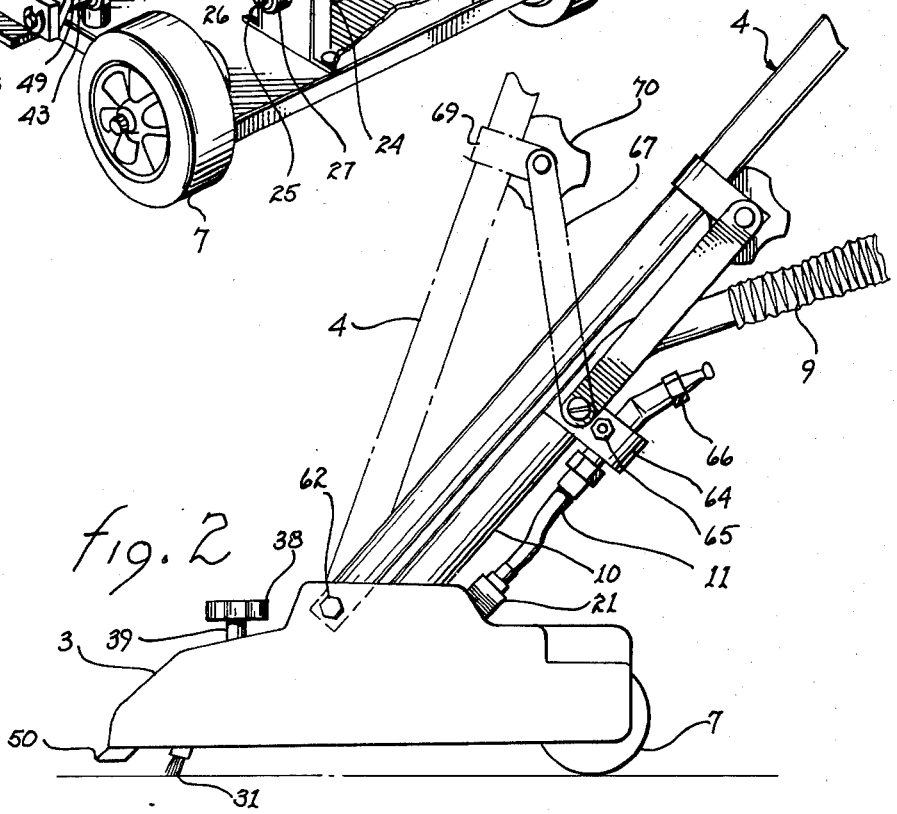
FIG. 2 is a side view of the wand illustrating the lockably pivotally positionable handle.

In operation, on loosening of clamp 69, handle 4 is pivotable about nut and bolt means 62 to the position indicated by phantom lines in FIG. 2 (or any position intermediate thereto). On pivotal movement of conduit 4, clamp 69 slides upwardly or downwardly along the handle while braces 67 and 68 are correspondingly angularly reoriented. Upon positioning of handle 4 at a selected angle, for the benefit of the operator or to accommodate obstructions to passage of wand 1, knob 70 is turned to tighten clamp 69 and lock the handle at the selected position. To reposition the handle, clamp 69 is easily manually loosened to accommodate further pivotal movement.

Referring primarily to FIGS. 1, 3, 4 and 5, the construction of chassis 2 will be reviewed. Of prime importance in any wand for a carpet soil extractor is the pressure of the snout bearing upon the pile of the carpet in order to maximize the suction effect of the vacuum within the vacuum head. That is, a relationship in the nature of a seal intermediate the perimeter of the snout and the pile of the carpet is sought to maximize the quantity of mixture of cleaning solution and dirt drawn into the snout. By experimentation with the present configuration of the invention, it has been learned that if the weight supported by the carpet at the perimeter of the snout is approximately twenty to twenty-five pounds, a sufficient pressure is developed to provide a very adequate seal such that the carpet is only slightly damp or near dry after passage thereacross of the snout. However, to establish the needed pressure at snout 50, lead blocks 75 and 76 are secured within conforming depressions in chassis 2. It has been learned that if each of the blocks weigh approximately eight pounds each, snout 50 bears down on the pile of the carpet with sufficient pressure to establish the seal. To facilitate transportation of the wand to and from location and across the carpet being cleaned, wheels 7 and 8 are disposed at opposite sides on one end of chassis 2.

As alluded to earlier, the force of the cleaning solution injected into the pile of the carpet tends to loosen and raise the dirt entrained therein. Subsequently, vacuuming of the mixture of cleaning solution and dirt will result in removal of at least some of the dirt. To aid in dislodging the entrained dirt and place it into suspension, scrubbing of the pile with a brush is of great benefit. Such scrubbing, if performed upon at least opposed sides of the strands forming the pile of the carpet, maximizes the surface area scrubbed and maximizes dislodgement of the dirt. Moreover, as a single wand must normally be used to clean a variety of types of carpet having various depths of nap, some means are preferably available to insure scrubbing by the brush into an adequate depth of the pile of the carpet without the possibility of exerting an injurious scrubbing force. The mechanism employed in the present invention which accomplishes these results will be described hereinafter with reference to FIGS. 1, 3, 4 and 5.

Motor 15 is mounted in the conventional manner upon chassis 2 and generally intermediate wheels 7 and 8. A cover 16 envelopes the motor and the requisite electrical connections in accordance with various safety requirements. Electrical conductor 17 extending from motor 15 is routed to console 5 disposed at the junction of handle 4 and handgrips 18, 19. A speed control having a knob 6 protruding from the console provides for manual regulation of the speed of motor 15. Output shaft 24 of the motor includes an offset pin 25, which pin defines a circular path on energization of the motor. An arm 26 is secured to pin 25 through a ball joint 27. The arm is also pivotally secured to an arm 41 by a pivot pin 42. Arm 41 is pinned or otherwise fixedly secured to shaft 43, which shaft is journalled within posts 44, 45 and 46 extending upwardly from chassis 2. Linkage mechanisms defining parallelogram linkages are attached to shaft 43 and extend along each of the opposed sides of chassis 2 to support brush 31. For brevity, only one of the parallelogram linkage mechanisms (40) will be described in detail as the structure and operation of both are identical.

Figure 5:
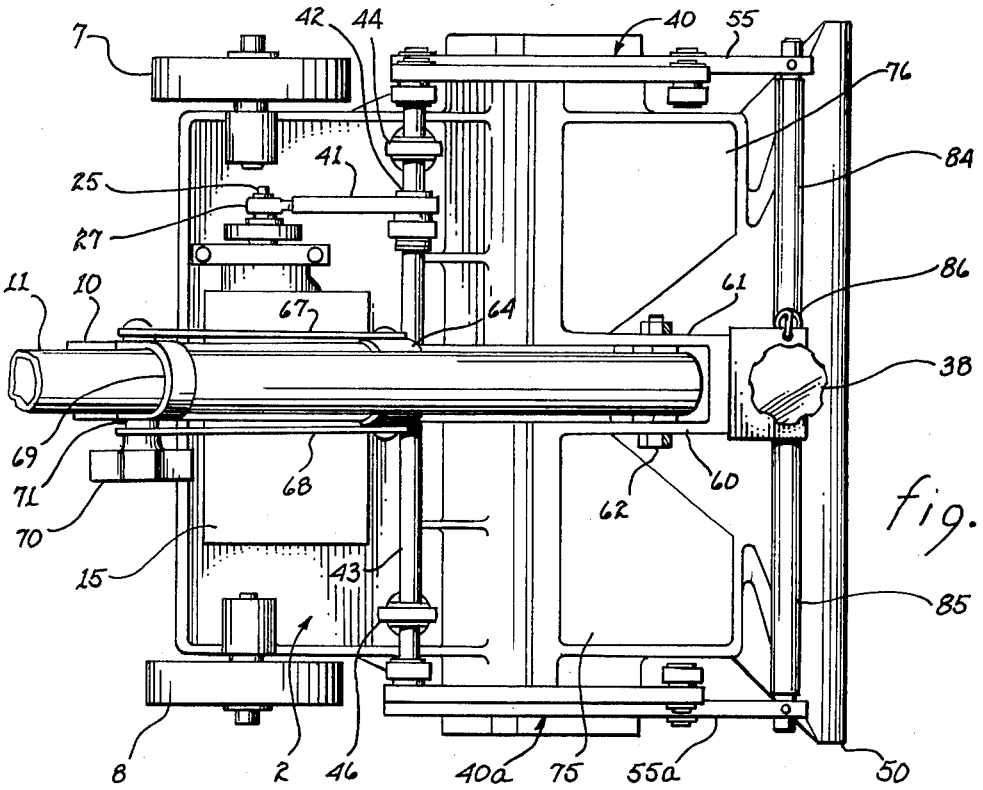
FIG. 5 is a top view of the wand.
Figure 6:
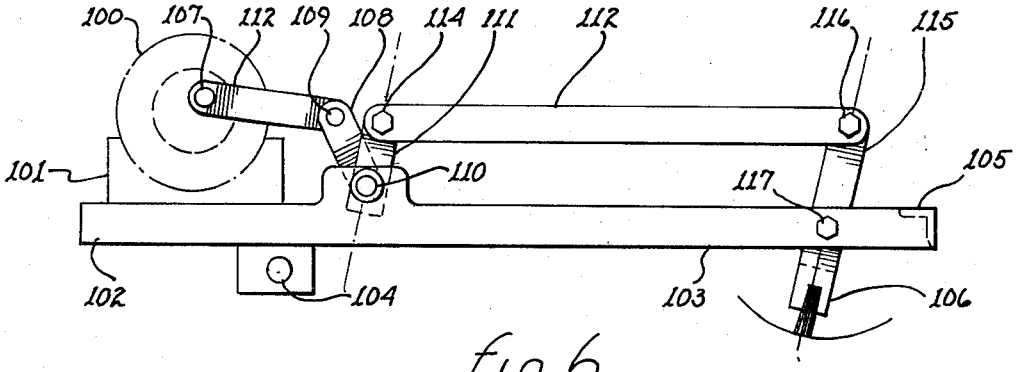
FIG. 6 is a schematic side view of a first variant of the brush linkage mechanism.
Figure 7:
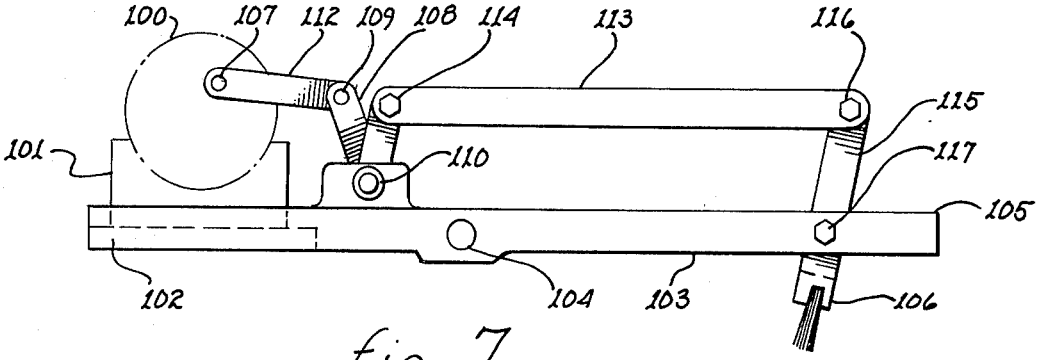
FIG. 7 is a schematic side view of a second variant of the brush linkage mechanism.

The parallelogram linkage mechanism illustrated in FIGS. 1, 3 and 5 is a parallelogram linkage since the opposed pairs of arms are of equal length and parallel to one another. Variations thereof, such as shown in FIGS. 6 and 7 for example, may not define true parallelograms. For purposes of simplicity of terminology the term "parallelogram linkage" will be used to identify both the preferred embodiment and the variants thereof discussed and derivable from the teachings of the invention. Moreover, the term "parallelogram-like linkage" will be used in the claims appended hereto to recite and embrace not only parallelogram linkages as described and illustrated but also variants thereof which generally embody the functional features features of parallelogram linkages.

Link 47 is pinned or otherwise fixedly secured to one end of shaft 43; it has been learned that the most favorable geometrical relationship results if link 47 is in angular alignment with arm 41 with respect to shaft 43. One end of link 48 is pivotally attached to the extremity of link 47 by a pin 49. The other end of link 48 is pivotally attached to one end of link 53 by a pin 54. The other end of link 53 is rigidly attached to backing plate 32 of brush 31. One end of link 55 is pivotally secured to the extremity of shaft 43 adjacent the pinned end of link 47. Link 55 is pivotally attached to link 53 by a pin 56 at a position therealong such that links 48 and 55 are parallel to one another and such that links 47 and 53 are parallel to one another. The other end of link 55 receivingly engages one end of a rod 57 extending across chassis 2 above and in proximity to snout 50 of the vacuum head. The linkages and their interrelationships which form linkage mechanism 40*a* are equivalent to that described above with respect to linkage mechanism 40 and like elements have the same reference numerals with the subscript "a".

From the above description it will be apparent that the linkage mechanisms form a suspension system for brush 31 which is pivotally attached to chassis 2 but vertically pivotable with respect thereto.

The operation of linkage mechanisms 40 and 40*a* will now be described. On energization of motor 15, output shaft 24 will rotate and pin 25 will be translated about a circular path, the radius of which is equivalent to the degree of offset of the pin. The movement of pin 25 will result in reciprocating and angular motion of arm 26, which motion is translated into a reciprocating pivotal motion of arm 41. Since arm 41 is pinned to shaft 43, the shaft will cyclically rotate to the extent of the arc defined by the movement of arm 41. The cyclical rotation of shaft 43 is transferred to pinned link 47 which causes the upper end of the link to reciprocally travel through a predetermined arc. The movement of link 47 is translated into longitudinal movement of link 48, which movement is essentially equivalent to the length of the chord described by the arc through which upper pivot point of link 47 translates. Movement of link 48 is translated into pivotal movement of link 53 about pin 56 through an arc equivalent to that defined by link 47. Since brush 31 is secured to the lower extremity of link 53 and as the lower end is displaced from pin 56, the brush will reciprocally travel through the same predetermined arc. It may be noted that link 55 serves primarily as a stabilizing element to maintain links 47, 48 and 53 in fixed geometrical relationships with respect to one another; moreover, this link does not pivot cyclically in response to rotation of the motor output shaft.

To modify or vary the force of brush 31 acting upon the pile of the carpet being cleaned, the vertical position of the bristles of the brush are raised or lowered with respect to snout 50. Such raising or lowering is accomplished by manually adjusting spring 34, as illustrated in FIGS. 1, 3, 4 and 5, to vary the angular orientation of links 55 and 55*a* with respect to the chassis. Stated another way, the brush suspension system is urged downwardly with respect to the chassis to a greater or lesser degree by the force of spring 34.

The lower end of spring 34 is retainingly engaged to the approximate midpoint of shaft 57 by a washer 35 having a circular channel for receiving the end coil of the spring; alternatively, the spring may be fixedly attached to shaft 57. The upper end of spring 34 is disposed within an inverted closed end cylinder 36 attached to chassis 2 by means of a flange 80 of bracket 37. A knob 38, having a threaded shaft 39 extending downwardly therefrom, threadedly penetrates flange 80 and base 81 of cylinder 36. The lower end of shaft 39 bears against a washer 82 having a peripheral ridge mating with the upper coil of spring 34.

By inspection, it will become apparent that as spring 34 is compressed through manual turning of knob 38, the downward force acting upon shaft 57 will increase. By increasing the downward spring force acting upon shaft 57, links 55 and 55*a* will be biased downwardly, which bias is translated through links 53 and 53*a* to bristles 30 of brush 31. By insuring that the maximum force imparted by coil spring 34 is less than the pressure bearing against the pile of the carpet at snout 50, even maximum compression of the spring resulting in maximum force of the brush against the carpet will be insufficient to raise the snout off the pile of the carpet. Further, by limiting the maximum force exertable by spring 34 to a force such that the difference between the force of brush 31 tending to raise the snout and the force exerted by the weight of the chassis at the snout is at least sufficient to maintain the above discussed seal intermediate the periphery of the snout and the pile of the carpet, sufficient suction through the snout will be maintained regardless of the bias imposed upon the brush. By limiting the maximum compression of spring 34 through knob 38 to a value less than complete compression of the spring, resilience of the brush is still maintained; accordingly, shock loading transmitted by the brush to the chassis is reduced at all settings and accommodation of travel by the brush over obstructions continues to exist.

To preclude chatter by intermittent contact between shaft 57 and the adjacent exterior surface of vacuum head 51, noise dampening tubing 83 and 84 may be mounted upon the shaft. To insure continuing engagement of spring 34 intermediate washers 35 and 82, a further spring 86 under tension interconnects shaft 57 and flange 80. Necessarily, the force of spring 86 must be overcome by spring 34 in order to create a downward bias upon shaft 57 and brush 31 but the criteria for selecting springs of appropriate spring rate is well known.

From the above description of the structural features of linkage mechanisms 40 and 40*a*, several conclusions become readily apparent. First, linking mechanisms 40 and 40*a* are pivotally mounted to chassis 2 by shaft 43 which renders them pivotable independent of the chassis. Second, a parallelogram linkage insures continuing reciprocating pivotal movement of brush 31 through a predetermined arc regardless of the pivotal position of the linkage mechanisms relative to chassis 2. Third, the downward force exerted by brush 31 is readily maintainable at a value insufficient to raise snout 50 off the pile of the carpet to a degree sufficient to negatively affect the vacuuming capability of the snout. Fourth, all depth and types of carpet piles can be efficiently scrubbed by brush 31 by modifying the downward force exerted by the brush through readily adjustable manually operated means. Fifth, the downward force exerted by the brush is not dependent upon nor variable because of the normal shortening of the bristles due to wear. Sixth, brush 31 is relatively inexpensive and is readily replaceable. Seventh, the mode of operation of all moving parts permits the employment of robust long wearing elements for added ruggedness of the wand. Eighth, by varying the effective length of arm 41 through varying the distance intermediate the center line of shaft 43 and pin 42, the arc described by brush 31 may be increased or decreased without other modification of the linkage mechanism. Nineth, by altering the angular orientation of arm 41 through lengthening or shortening of arm 26, the arc described by the pivoting brush may be skewed forward or rearward of vertical without other modification of the linkage mechanisms. Tenth, by raising or lowering links 40 and 40*a* by varying the compressive force exerted by spring 34, the center line of the arc described by brush 31 will vary slightly with respect to vertical but it has been found that as a practical matter the degree of variation has no discernible effect upon the scrubbing effectiveness of the brush.

Referring to FIG. 6, there is illustrated a first variant of the brush actuating linkage mechanism described above. Motor 100, resting upon a mounting block 101 is secured to a plate 102. The plate is fixedly attached intermediate a pair of opposed links (of which link 103 is illustrated) extending along either side of the chassis. These links in combination with plate 102 define a rigid suspension system for brush 106 and the brush actuating linkage mechanisms. The suspension system, in totality, is pivotally supported upon the chassis at pivot point 104. This pivot point allows for selective application of a downward force at end 105 of link 103 to pivot the suspension system and urge brush 106 into forceful engagement with the pile of the carpet being cleaned.

The output shaft of motor 100 includes a longitudinally aligned offset pin 107 in engagement with one end of an arm 112. The other end of the arm is pivotally attached to a driving link 108 at pivot point 109. Driving link 108 is pinned or otherwise affixed to a shaft 110 rotatably supported by the opposed links (103). Link 111 is pinned or otherwise secured to shaft 110 and pivotally interconnects with one end of link 113 at pivot point 114. The other end of link 113 is pivotally secured to brush link 115 at pivot point 116. Brush link 115 supports brush 106 and is pivotally secured to link 103 at the pivot point 117. The configuration presented by links 103, 111, 113 and 115 is that of a parallelogram-like linkage whereby any reciprocal angular movement of link 111 produced through operation of motor 100 is reproduced by link 115. Thereby, the angle through which brush 106 reciprocally pivots is directly proportional to the geometrical relationship between the offset of pin 107 and the length of arm 108.

An advantage of the variant illustrated in FIG. 6 comes about through the use of a common support or platform for both the actuating mechanism and the linkage mechanisms.

By inspection, it will become apparent that as the downward bias force exerted at end 105 of link 103 is increased (such as by a spring equivalent to spring 34 described above), the offset of pivot point 104 with respect to the longitudinal axis of link 103 will produce a left or right shifting of the suspension system equivalent to the chord of the arc through which the link is pivoted by the bias force. Such shifting will also displace the center line of the arc through which brush 106 reciprocates by an equivalent distance. The resulting pivotal movement of link 103 due to the increase or decrease in the bias force applied at end 105 will also angularly translate forwardly or rearwardly the center line of the arc through which the brush reciprocates by an equivalent angle.

The variant illustrated in FIG. 7 is essentially identical to that of the variant shown in FIG. 6 except that the pivot point for link 103 is on the horizontal center line of pivot point 117. Thereby, a bias force applied to end 105 of link 103 produces no left or right shifting of link 103. The only translation of brush 106 as a result of increasing or decreasing the bias force at end 105 is that of angularly reorienting the center line of the arc through which the brush reciprocates.

In both of the variants illustrated in FIGS. 6 and 7, it may be appreciated that all of the moving elements are mounted upon a common support, which support is pivotally attached to the chassis. Thereby, warpage, manufacturing tolerances and other discrepancies which may arise with regard to the trueness of the chassis have absolutely no effect upon the geometry, the linkage mechanisms and the actuating mechanisms. Moreover, as the linkage and actuating mechanisms can be assembled as a unit apart from the chassis as a whole, the various geometric relationships can be more easily set and permanently established at optimum values in the factory through the use of jigs and the like.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A wand of a carpet soil extractor for cleaning carpets, said wand including a vacuum conduit connectable with a source of vacuum, a cleaning solution conduit connectable with a source of cleaning solution under pressure and electrical conductors connectable to a source of electric power, said wand comprising in combination:

a. a chassis;

b. wheel means secured at one end of said chassis for aiding in the transport of said wand across the carpet to be cleaned;

c. said chassis including vacuum head means in fluid communication with the vacuum conduit for extracting a mixture of dirt and cleaning solution from the carpet, said vacuum head means including a snout bearing against the carpet and providing vertical support for said wand;

d. weight means for increasing the pressure of said snout acting upon the carpet to urge penetration of said snout into the nap of the carpet;

e. said chassis including nozzle means in fluid communication with the cleaning solution conduit for directing the cleaning solution into the carpet;

f. brush means for scrubbing the carpet wetted with the cleaning solution, said brush means including:

(1) a generally downwardly directed brush;

(2) an electric motor having a rotary output, said motor being electrically connected to the electrical conductors;

(3) linkage means interconnecting the rotary output and said brush for translating the motion of the rotary output to a reciprocal arcuate motion of said brush; and (4) pivot means for pivotally supporting said linkage means and said brush with respect to said chassis; and g. bias means disposed intermediate said chassis and said brush for urging said brush into continuing contact with the carpet.

2. The wand as set forth in claim 1 wherein said linkage means comprises:

a. a shaft rotatably mounted upon said chassis;

b. arm means interconnecting the rotary output of said motor with said shaft for imparting a reciprocating rotational movement to said shaft through a predetermined angle; and c. a parallelogram-like linkage mechanism interconnecting said shaft and said brush for translating the rotational movement of said shaft to reciprocating pivotal movement of said brush.

3. The wand as set forth in claim 2 wherein said parallelogram linkage mechanism comprises a pair of parallelogram-like linkage mechanisms disposed along opposed sides of said chassis, each of said pair of parallelogram linkage mechanisms being connected to said shaft.

4. The wand as set forth in claim 3 wherein said bias means comprises:

a. a rod connectably disposed intermediate said pair of parallelogram-like linkage mechanisms;

b. spring means disposed intermediate said rod and said chassis for urging relative movement between said pair of parallelogram linkage mechanisms and said chassis; and c. adjustment means for varying the force imparted by said spring means; whereby the force of said brush bearing against the carpet is variable.

5. The wand as set forth in claim 4 wherein said linkage means includes an offset pin extending from the rotary output of said motor and said arm means comprises:

a. a first arm pivotally secured to said pin for translating the rotary motion of said pin into a linear motion; and b. a second arm fixedly secured to said shaft and pivotally secured to said first arm for translating the linear motion of said first arm into reciprocal rotary motion of said shaft.

6. The wand as set forth in claim 5 wherein each of said pair of parallelogram linkage mechanisms includes a link fixed to said shaft and in angular alignment with said second arm.

7. The wand as set forth in claim 4 including:

a. a handle for transporting said wand, said handle being pivotally secured to said chassis;

b. a releasably attached sliding clamp means secured to said handle;

c. a collar secured to the vacuum conduit;

d. brace means pivotally interconnecting said clamp means and said collar for accommodating reorientation of said handle with respect to said chassis; whereby, the angle of said handle with respect to said chassis is adjustable.

8. The wand as set forth in claim 7 wherein said clamp means includes a manually adjustable clamp.

9. The wand as set forth in claim 1 including:
a. a handle for transporting said wand, said handle being pivotally secured to said chassis;
b. a releasably attached sliding clamp means secured to said handle;
c. a collar secured to the vacuum conduit;
d. brace means pivotally interconnecting said clamp means and said collar for accommodating reorientation of said handle with respect to said chassis; whereby, the angle of said handle is adjustable by releasing said clamp means.

10. The wand as set forth in claim 1 wherein said linkage means comprises:
a. link means disposed at opposed sides of said chassis for supporting said motor and said brush, said link means being supported upon said chassis by said pivot means;
b. a shaft rotatably mounted upon said link means;
c. arm means for translating the rotary output of said motor into reciprocating rotation of said shaft; and
d. a parallelogram-like linkage mechanism secured to said link means for translating the reciprocating rotation of said shaft into reciprocating pivotal movement of said brush; whereby, the operative elements for said brush are pivotally suspended independent of said chassis.

11. The wand as set forth in claim 10 wherein said link means comprises one link of said parallelogram-like linkage mechanism.

12. The wand as set forth in claim 11 wherein said parallelogram linkage mechanism comprises a pair of parallelogram-like linkage mechanisms disposed along opposed sides of said chassis, each of said pair of parallelogram-like linkage mechanisms being connected to said shaft.

13. The wand as set forth in claim 12 wherein said linkage means includes an offset pin extending from the rotary output of said motor and said arm means comprises:
a. a first arm pivotally secured to said pin for translating the rotary motion of said pin into a linear motion; and
b. a second arm fixedly secured to said shaft and pivotally secured to said arm for translating the linear motion of said first arm into reciprocal rotary motion of said shaft.

14. The wand as set forth in claim 13 including:
a. a handle for transporting said wand, said handle being pivotally secured to said chassis;
b. a releasably attached sliding clamp means secured to said handle;
c. a collar secured to the vacuum conduit;
d. brace means pivotally interconnecting said clamp means and said collar for accommodating reorientation of said handle with respect to said chassis; whereby, the angle of said handle with respect to said chassis is adjustable.

15. The wand as set forth in claim 10 wherein said pivot means is disposed beneath the longitudinal axis of said link means.

16. The wand as set forth in claim 10 wherein said pivot means is disposed along the longitudinal axis of said link means.

17. In a wand of a carpet soil extractor for scrubbing and vacuuming a carpet wetted with a cleaning solution, said wand including at least one wheel disposed at one end of the chassis of said wand for pivotally supporting said wand upon the carpet and a snout of a vacuum head disposed at the other end of the chassis for bearing against and vacuuming the carpet, the improvement comprising in combination:
a. brush means for scrubbing the wetted carpet;
b. power means for providing a source of power;
c. linkage means connecting said power means to said brush means for reciprocating said brush means through an arc having a horizontal pivot point;
d. pivot means for pivotally supporting said linkage means and said brush means to accommodate vertical movement of said brush means with respect to the snout; and
e. bias means for urging downward pivotal movement of said linkage means to bring said brush means into engagement with the carpet.

18. The improvement as set forth in claim 17 wherein said linkage means comprises:
a. a rotatably mounted shaft;
b. arm means interconnecting said power means and said shaft for imparting a reciprocating rotational movement to said shaft; and
c. a parallelogram linkage mechanism interconnecting said shaft and said brush means for translating the rotational movement of said shaft into reciprocating movement of said brush means through an arc.

19. The improvement as set forth in claim 18 wherein said parallelogram linkage mechanism comprises a pair of parallelogram linkage mechanisms disposed along opposed sides of said wand, each of said pair of parallelogram linkage mechanisms being connected to said shaft.

20. The improvement as set forth in claim 19 wherein said bias means comprises:
a. rod means connectably disposed intermediate said pair of parallelogram linkage mechanisms;
b. spring means disposed intermediate said rod means and the snout for urging relative movement between said pair of parallelogram linkage mechanisms and the snout; and
c. adjustment means for varying the force imparted by said spring means; whereby, the force of said brush means bearing against the carpet is variable.

21. The improvement as set forth in claim 20 including:
a. handle means for transporting said wand;
b. clamp means secured to said handle, said clamp means being slidably positionable along said handle;
c. brace means having one end pivotally secured to said clamp means;
d. means for pivotally supporting the other end of said brace means with respect to said wand; whereby, said handle is pivotally repositionable with respect to said wand by selectively slidably positioning said clamp means along said handle.

22. The improvement as set forth in claim 20 wherein said shaft is rotatably mounted on the chassis of said wand.

23. The improvement as set forth in claim 22 wherein said pivot means comprises said shaft.

24. The improvement as set forth in claim 19 wherein each of said pair of parallelogram-like linkage mechanisms includes a link and said shaft is rotatably mounted upon said links.

25. The improvement as set forth in claim 24 wherein said power means is supported by and intermediate said links.

26. The improvement as set forth in claim 25 wherein said pivot means comprises a pivot point displaced from the longitudinal axis of said links.

27. The improvement as set forth in claim 25 wherein said pivot means comprises a pivot point intercepting the longitudinal axis of said links.

* * * * *